US008860534B2

(12) United States Patent
Laufenberg

(10) Patent No.: US 8,860,534 B2
(45) Date of Patent: Oct. 14, 2014

(54) OVERCURRENT SWITCHING DEVICE

(75) Inventor: Markus Laufenberg, Radolfzell (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 13/639,905

(22) PCT Filed: Mar. 31, 2011

(86) PCT No.: PCT/EP2011/054992

§ 371 (c)(1),
(2), (4) Date: Oct. 15, 2012

(87) PCT Pub. No.: WO2011/124518

PCT Pub. Date: Oct. 13, 2011

(65) Prior Publication Data

US 2013/0043963 A1 Feb. 21, 2013

(30) Foreign Application Priority Data

Apr. 8, 2010 (DE) ..... 10 2010 014 280

(51) Int. Cl.

| | |
|---|---|
| ***H01H 75/00*** | (2006.01) |
| ***H01H 73/12*** | (2006.01) |
| ***H01H 73/00*** | (2006.01) |
| ***H01H 83/06*** | (2006.01) |
| ***H01H 71/14*** | (2006.01) |

(52) U.S. Cl.

CPC ..... *H01H 71/145* (2013.01)
USPC ..... 335/18; 335/21

(58) Field of Classification Search

USPC ..... 335/6–27, 215, 220–232; 310/26
See application file for complete search history.

(56) References Cited

U.S. PATENT DOCUMENTS

| | | | |
|---|---|---|---|
| 4,205,293 | A | 5/1980 | Melton et al. |
| 4,806,815 | A | 2/1989 | Honma |
| 7,765,689 | B2 | 8/2010 | Irish et al. |
| 2008/0284547 | A1 | 11/2008 | Claeys et al. |
| 2011/0057751 | A1 | 3/2011 | Feil et al. |

FOREIGN PATENT DOCUMENTS

| | | |
|---|---|---|
| DE | 10 2004 056 280 | 5/2006 |
| EP | 0 866 484 | 9/1998 |
| JP | 01057546 | 3/1989 |
| WO | 2008/098531 | 8/2008 |

OTHER PUBLICATIONS

International Search report dated Jul. 25, 2011.
German Office action dated Jun. 24, 2010.

*Primary Examiner* — Bernard Rojas
(74) *Attorney, Agent, or Firm* — Bachman & LaPointe, P.C.

(57) ABSTRACT

An overcurrent switching device for an electric circuit to be monitored, which has interrupter contact means (14) constructed in such a manner that an interruption of the electric circuit is effected as a reaction to the exceeding of a predetermined current threshold, wherein the interrupter contact means have an expansion unit (16) realized by means of a magnetically active shape memory alloy material, which is loaded by a magnetic field (18) of a current flowing in the electric circuit, characterized in that the expansion unit (16; 30; 32; 34) mechanically driving a contact, particularly an interrupter contact (14), is provided adjacently to a coil-free current-carrying conductor section (10) of the electric circuit for magnetic interaction in such a manner that above the predetermined current threshold, a current flow in the current carrying conductor section generates a magnetic field which effects an expansion movement of the expansion unit which interrupts the electric circuit.

18 Claims, 2 Drawing Sheets

Fig. 1
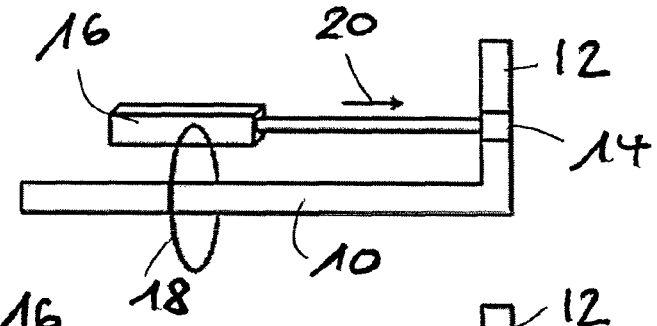
Fig. 2
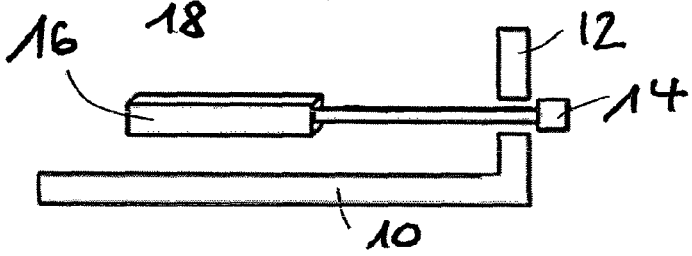
Fig. 3
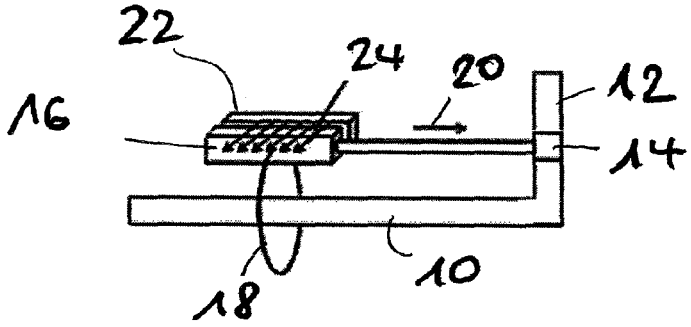
Fig. 4
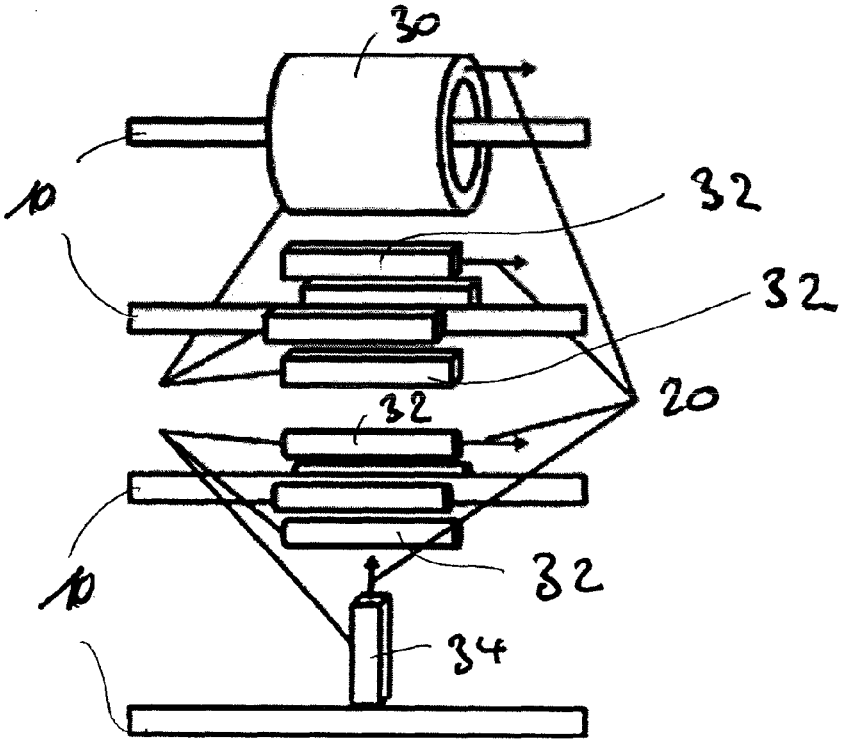
Fig. 5
Fig. 6
Fig. 7

OVERCURRENT SWITCHING DEVICE

BACKGROUND OF THE INVENTION

The present invention relates to an overcurrent switching device.

Protective switches in the form of overcurrent switches have been known from the prior art for many years. They have the object of preventing a high current flow in an electric circuit caused for example by a short circuit by interrupting the electric circuit, as a result of which further dangers and problems such as for example damaging a consumer, accident risk or the like can be minimised.

It is also in particular known from the prior art, in addition to conventional technologies such as the use of bimetals, to also use so-called shape memory alloys (abbreviation: MSM, magnetic shape memories), namely those materials which show a change in length as a reaction to an applied magnetic field (typically an expansion of the material). This magnetic expansion effect is utilised for a multiplicity of applications, and for example has gained entry into electrical switching and safety technology for example on the basis of the teaching of DE 10 2004 056 280 A1. Furthermore, MSM alloys are generally also so-called thermal shape memory alloys at the same time. In addition to the structural change within the martensite which forms the basis of the MSM effect, there is namely also a phase conversion between martensite and austenite, which typically also leads to a length change of a corresponding body.

In the MSM technology mentioned and called upon to form the generic type, the current to be monitored for overcurrent flows through a coil which therefore becomes part of the electric circuit to be monitored and/or protected against overcurrent, and creates a current-strength dependent magnetic field there which acts upon an MSM material (which is provided for example in the manner of an armature in the coil in the prior art described). An exceeding of a current-strength threshold value predetermined by the expansion characteristics of the MSM element leads to the intended length change of the MSM element being effected and a switching contact provided (typically at the end) on the MSM element then interrupts the electric circuit in the manner of a protective switch functionality and thus effects the desired overcurrent protection.

A procedure of this type however initially has the disadvantage that substantial hardware or circuit outlay is necessary: In addition to the MSM element to be provided or fastened in a suitable manner, this must magnetically interact with the coil unit (which forms part of the electric circuit) and be suitably configured and set up, furthermore such a coil/MSM switching element combination is not arbitrarily universally usable, as for each use case (with a current threshold for electric circuit interruption to be monitored in each case) a respectively individual adaptation of a coil (for creating the necessary magnetic field) relative to the MSM element is necessary.

A further disadvantage in principle consists in the action of the coil as inductor, so that particularly in the case of a rapid sudden increase of the current, this is delayed (due to the inductance) and insofar induces a correspondingly slow triggering by means of the MSM element. In short-circuit situations or the like in particular, a procedure of this type is therefore sluggish on account of the system.

A device which additionally shows the features of an overcurrent switching device is known from WO 2007/057030 A1. For further prior art, reference is made to WO 2008/098531 A1 and also EP 1 610 418 A2.

SUMMARY OF THE INVENTION

It is therefore the object of the present invention to improve an overcurrent switching device as disclosed herein with regards to the hardware realisation outlay, the usability and configurabiliity and also the dynamic behaviour thereof, particularly the response characteristic for triggering an MSM expansion.

The object is achieved by means of the overcurrent switching device as disclosed herein. Advantageous developments of the invention are also described herein. Also claimed as belonging to the invention is any combination of disclosed features of the invention in any desired combination, as long as it makes sense from a technical standpoint. Further claimed as belonging to the invention is a method for monitoring an electric circuit that can be recognised from all of the documents present, particularly for operating an overcurrent switching device with the features disclosed herein, with the method steps and method procedures emerging from the documents.

In an advantageous manner according to the invention, the expansion unit realised by means of a magnetic shape memory (MSM) alloy material is assigned to the electric circuit in such a manner that a magnetic interaction with a coil-free conductor section (more precisely: a magnetic field generated by the current flow in this conductor section) takes place in such a manner that a magnetic field is built up when the current threshold is reached or exceeded, which leads to an expansion movement of the expansion unit (located in a position arranged correspondingly to the conductor section).

This then directly has the advantage that a complex design and individual configuration (dependent on the field of use) of a coil with the MSM element becomes unnecessary, rather to enable the function of this unit, only the expansion unit (preferably realised in an elongated manner for constructing a direction of expansion and extent) is to be brought so close to the conductor section (if appropriate to be anchored there in a suitably adjustable manner) that an expansion (with the electric circuit interruption caused thereby) is effected in the intended manner in the case of the magnetic field influence above a threshold value determined by the current threshold. In this case, the term "expansion" is also to be understood as "negative expansion" in the sense of a contraction, if, for example due to particular installation or configuration conditions, a possible contraction effect should be utilised. It is also not necessarily implied in the context of the invention that the interruption of the electric circuit directly takes place by means of the movement action of the MSM material, rather this can also actuate a suitable switch (acting mechanically or electronically) by means of expansion.

Additionally advantageously, the magnetic interaction between the coil-free conductor section and the expansion unit ensures that no (inductively caused) delays in the increase of the magnetic field strength (as a reaction for example to a rapid current increase) result, thus such a procedure according to the invention has clear dynamic and response speed advantages compared with conventional devices using a coil. In this case, the term "coil-free" is to be defined in such a manner in the context of the invention that the current-carrying conductor section according to the invention does not necessarily have to run linearly (this can rather also be present in a curved or angled manner in the relevant region), such an arrangement which does not form a winding-type structure and/or in the manner present here does not have a significantly increased inductance compared to an elongated conductor structure (wherein this should apply in particular against the background of a mains power monitoring, that is to say at typical mains frequency) is to be understood as "coil-free" however.

To achieve a realisation which is of simplest possible design, it is preferred to construct the current-carrying conductor section for interaction with the expansion unit in an elongated or linear manner at least in certain sections and to configure the expansion unit parallel thereto in a correspondingly linear and elongated manner; here only a precise adjustment and setting up of the magnetic coupling can be realised, also a movement and thus switching direction can be preferably axially predetermined by means of the elongated MSM element (as expansion unit), which direction is beneficially suitable to arrange a contact effecting the desired interruption of an electric circuit directly thereon.

On the basis of the high currents, which are caused by the structure or design principle of the present invention, in the conductor track section for generating the magnetic field which moves or triggers the expansion unit, it may be useful in the context of preferred developments of the invention, to magnetically prestress the MSM material of the expansion unit, for example by means of the use of permanent magnets, i.e. to assign permanent magnet means to the expansion unit in such a manner that the same reduce an overlaid magnetic field required for effecting the expansion, with the effect that the current threshold generating the overlaid magnetic field can fall significantly. In other words, in addition to positional orientation (distance orientation) of the expansion unit relative to the conductor track section, the provision of suitable permanent magnets according to preferred developments of the invention enables the adjustment or setting of a desired current threshold.

In this case, a distance setting (with or without permanent magnet means) can either take place permanently, e.g. by means of suitable adhesives or the like, alternatively, an e.g. mechanically adjustable or actuatable holder, may be provided in an otherwise known manner, in order to set a suitable engagement or effective distance between the conductor section and expansion unit and/or permanent magnet, for setting or adjusting the threshold current effecting the expansion.

In addition, by means of further magnetic and/or mechanical measures and elements according to preferred developments of the invention, the expansion behaviour (and thus switching behaviour) of the overcurrent switching device according to the invention can be influenced: Thus, it is possible on the one hand and included in the invention in accordance with a development, to assign a spring (e.g. a compression spring) to the MSM expansion unit as energy store, so that a movement or expansion of the expansion unit induced by a magnetic field takes place counter to the spring force and in this respect an influencing of the expansion and switching behaviour takes place. Complementarily or alternatively (and also in connection with one of the previously mentioned developments and variants), it is included by the present invention, to influence a magnetic field entry into the expansion unit, by means of the provision of suitable flux conduction elements, for example flux conducting elements of this type, are to be configured in such a manner that to achieve a switching behaviour which is as rapid and continuous as possible, a homogeneous field pattern is achieved in the expansion unit.

It is also in the context of preferred developments of the invention that the expansion unit can be configured surrounding the conductor section in one piece or multiple pieces: Thus, it is possible in accordance with a preferred embodiment to configure the MSM expansion unit in the manner of a hollow cylinder and to pass the current-carrying conductor section through this hollow cylinder or alternatively to arrange a plurality of MSM expansion units (which are typically elongated and/or run parallel to the current-carrying conductor section) around the conductor section.

In principle, no automatic contraction or retraction into the non-expanded initial position takes place in the MSM element as a reaction to a dropping of the magnetic field effecting the expansion. Rather, this is to be ensured by means of additional measures, such as for example the means provided in accordance with a development for resetting the expansion unit, which means further preferably require a manual intervention or control or switching process in the sense of a safety idea in practical use of the overcurrent switching device, namely after an operator has convinced themselves that the fault causing the overcurrent has been overcome.

A resetting of this type can alternatively also take place automatically, e.g. triggered by falling below the predetermined current threshold (if appropriate by a predetermined amount), wherein suitably prestressed springs are also suitable for a resetting of this type, as are permanent magnets or a shape memory alloy material set up in a contrary or opposite manner, which is controlled for carrying out the contraction or resetting movement on the expansion unit.

Whilst the basic idea of the present invention lies in the use of the magnetic field generated by the current-carrying conductor section for the expansion of the expansion unit triggering the interruption of the electric circuit in the event of overcurrent, it is nonetheless included by the invention in accordance with a development to additionally take thermal effects of an overcurrent situation into account. This can advantageously take place in that the magnetic shape memory alloy material for realising the expansion unit is additionally set up in a thermally expanding manner and thus is for example beneficially suitable to react to slow (and in turn overcurrent-caused) heating of surroundings of the expansion unit, with suitable thermal coupling and in this manner can carry out the expansion interrupting the current flow.

It is furthermore in the context of a particular embodiment of the present invention to configure the shape memory alloy material for realising the expansion unit itself as part of the electric circuit, in other words to guide a part of the current-carrying conductor track of the electric circuit by means of the shape memory alloy material. This initially has the advantageous effect that contact formation (or interruption of the contact) can be realised without coupling but rather as part of the electric circuit, with the potential to achieve a yet faster, more dynamic switching behaviour as a reaction to an overcurrent situation (which then, by means of the current flow in the MSM element itself, effects the magnetic field strength critical for the expansion there). This variant of the invention, like also the previously described principle of an expansion unit interacting with a conductor section of the electric circuit (but not part of the same) is similarly suitable for the development in accordance with the previously described principle, including for the targeted influencing of the expansion behaviour by means of an (overlaid) magnetic field of a permanent magnet, the provision of springs or similar energy stores or the setting up of suitable resetting means.

As a result, what emerges by means of the present invention in a surprisingly simple and effective manner is an overcurrent switching device which combines design simplicity with high operational speed and thus also potentially practically relevant alternatives for realising an effective overcurrent protection.

BRIEF DESCRIPTION OF THE DRAWINGS

Further advantages, features and details of the present invention result from the following description of preferred exemplary embodiments, as well as on the basis of the drawings. In the figures FIG. 1, FIG. 2 show a schematic illustration of a realisation of an overcurrent switching device according to a first exemplary embodiment of the invention, in which an elongated expansion unit is guided parallel to a current carrying conductor section of an electric circuit and has an elongation forming an interrupter contact for this electric circuit in an non-expanded operating state (FIG. 1) and also in the expanded interrupting switching state (FIG. 2);

FIG. 3 shows a variant of the exemplary embodiment of FIGS. 1 and 2 with a permanent magnet assigned to the expansion unit for generating an overlaid permanent-magnet field;

FIG. 4 to FIG. 7 show further variants for realising an overcurrent switching device with alternatively constructed expansion units, in the form of a hollow cylinder (FIG. 4), a plurality of expansion elements surrounding the conductor track section (FIGS. 5 and 6) and also for illustrating possible alternative orientations (FIG. 7) of the expansion unit;

DETAILED DESCRIPTION

Figure 8:
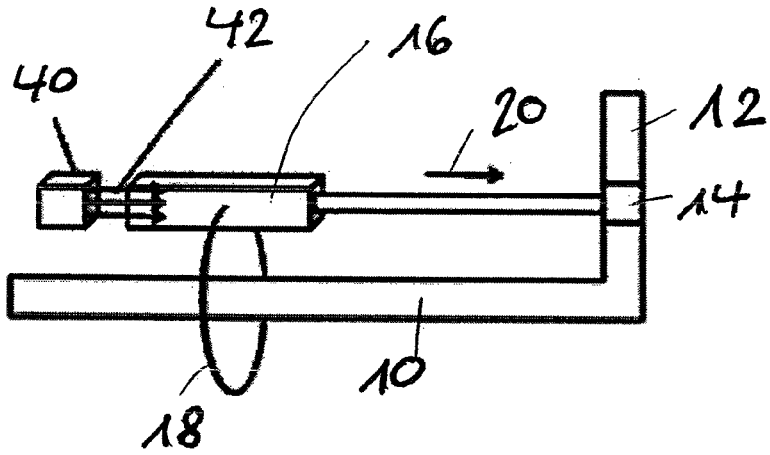
FIG. 8 shows an example for clarifying an (automatic) resetting of the overcurrent switching device of the exemplary embodiment in FIG. 1 and FIG. 2 by means of permanent magnets.

FIG. 1 clarifies a first possible embodiment of the invention in the schematic side view, in which embodiment an electric circuit running along a conductor section 10 and an angled section 12 adjacent thereto (wherein the further course of the closed electric circuit assigned to consumers in the conventional manner is not shown) can be opened in the region of the section 12 by a movable contact 14 by actuation by means of an expansion unit 16 made of a shape memory material (here realised by means of an NiMnGa alloy which is known per se).

More precisely, the expansion unit constructed in an elongated manner (approx. 20 mm edge length with a cross section of approx. 2×2 mm2 in the practical example) arranged at a distance of 1 mm from the conductor track section 10. Current flowing in the conductor track generates a magnetic field, indicated by means of a schematically shown field line 18, which magnetic field is coupled into the expansion unit 16 in the manner shown and triggers an expansion of the unit 16 when a critical flux density is exceeded. This leads along the arrow direction 20 in FIG. 1 to the driving of the unit 14; the electric circuit is opened in the region of the conductor 12 and the current flow is interrupted as a reaction to the thus detected overcurrent.

The following orders of magnitude clarify a parametrisation of such a device:

At a distance r from the central axis of a straight conductor, a current I generates a magnetic field strength H of $$H = \frac{1}{2\pi r},$$

where $$I = \frac{2\pi r B_{external}}{\mu_0}$$

(with the relationship BMSM=μr $B_{external}$), if $B_{external}$ describes the magnetic induction outside of the MSM material of the unit 16 in air or a vacuum and BMSM is the magnetic induction in the expansion unit which is required in the MSM material in order to trigger the expansion.

Further assuming that a typical flux density of B=1.25 T, then the following applies when μr=20 and r=0.001 m (that is to say 1 mm spacing between expansion unit and conductor):

$$I\frac{2\pi r B_{MSM}}{\mu_0 \mu_r} = \frac{2\pi \cdot 0.005 \cdot 1}{4\pi \cdot 10^{-7} \cdot 30} A = 833A.$$

This leads one to expect that a short-circuit current of somewhat above 800 A leads in the case of the configuration shown to the interruption of the electric circuit by means of the expansion of the MSM switching unit 16.

Analogously to the illustration of FIG. 1, FIG. 3 clarifies an option of influencing the magnetic flux by means of the MSM unit 16 (either with the purpose of suitably lowering or increasing the threshold, or else to create an adaptability to various adjustment or environmental conditions). For this purpose, a schematically shown elongated permanent magnet unit 22 of the MSM expansion unit 16 is assigned in parallel in such a manner that a permanent-magnet field (shown schematically by means of the bank of arrows 24) generated by the permanent magnet unit overlays the conductor field (symbolically shown in turn by reference number 18) to the extent, in the case of a permanent-magnet field 24 being present, that a lower current strength must flow through the conductor section 10 as current threshold in order to trigger the expansion switching procedure (movement in direction 20 due to expansion).

FIGS. 4 to 7 clarify developments and variants for arranging an expansion unit in the manner claimed according to the invention relative to a current-carrying conductor section in such a manner that a magnetic field generated in the conductor triggers an expansion of the expansion unit when a critical current threshold is exceeded. In FIGS. 4 to 7, to clarify the illustration, a conductor section is in turn designated with the reference number 10; an elongation direction of the respective expansion units receives the reference number 20 analogously to FIGS. 1 to 3: In the exemplary embodiment of FIG. 4, a hollow-cylindrical expansion unit 30 is realised as MSM alloy element. This surrounds the current-carrying conductor 10 in such a manner that when the magnetic field satisfactory for the expansion is reached or exceeded, an expansion takes place in the axial direction (20).

By contrast, the variants of FIGS. 5 and 6 show a plurality of individual elements 32, which are arranged around the current-carrying conductor in the circumferential direction and orientated parallel to the same, as MSM alloy bodies, wherein these may have suitable cross sections (for example quadrilateral in FIG. 5 and circular in FIG. 6) or other contours. Here, a coupling, which is not shown in detail, of a(n) (interrupter) contact unit, then takes place as also in the example of FIG. 4 (or FIG. 7).

The example of FIG. 7 clarifies that realisations are also possible, in which the expansion unit 34 does not have to be guided parallel to the current-carrying conductor, but rather can also have another relative angular configuration, e.g. orthogonally.

Figure 9:
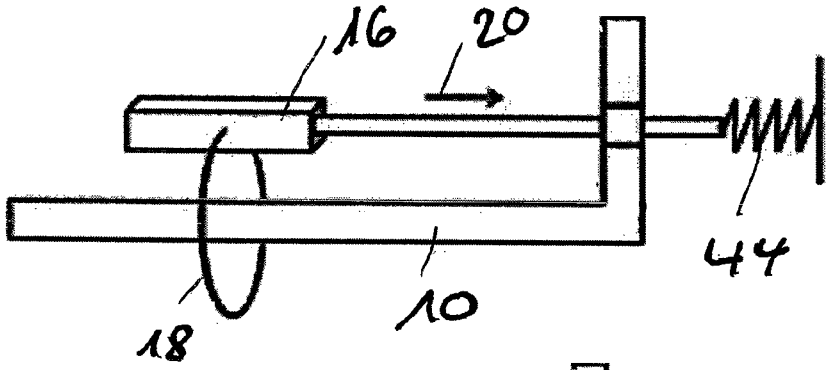
FIG. 9 shows an alternative for automatic resetting according to FIG. 8 by means of the provision of a schematically shown compression spring.

The FIGS. 8 and 9 clarify a further exemplary embodiment of the invention for realising a resetting of the expansion unit once expansion has taken place. In principle, the MSM alloy material does not also inherently contract into its initial position once expansion has taken place by means of the disappearance of the magnetic field on account of the current interruption, so that, in the context of an overcurrent switching device, a guiding back into an initial position must be possible for the further operation of the electric circuit. This can take place on the one hand manually (in a manner not shown in any more detail), alternatively FIGS. 8 and 9 clarify an automatic resetting by means of loading with force or a suitably orientated magnetic field, which is overcome in the event of switching due to expansion in the case of overcurrent and which effects an automatic resetting into the initial position after this state has ended, however.

Thus, the schematic exemplary embodiment of FIG. 8 shows the interaction of the expansion unit 16 (otherwise configured and arranged as in the principle example of FIGS. 1 *and* 2) with a permanent magnet unit 40 provided at the end, which exerts a permanent magnet force onto the unit 16 in the manner shown by means of the bank of arrows 42. When the overcurrent situation is reached (as described above), the unit 18 expands and drives the contact means 14 out of the conductor 12 for interrupting the electric circuit. However, as soon as the field formed in the conductor section 12 by the (lower) current flow there drops below a critical limit, the permanent magnet force (42) of the unit 40 prevails, so that the expansion unit 16 is brought back into its initial position by means of the permanent magnet field (and in turn accordingly by utilising the MSM effect). The arrangement shown in FIG. 8 is purely schematic in this case; depending on the desired force flow and use example, suitable (if appropriate also a plurality of) permanent magnet units 40 can be provided, or a mechanical prestress can be provided in a suitable manner.

An equivalent functionality is effected in the manner shown in FIG. 9: Here, in the event of an overcurrent, the expansion unit 16 works against a compression spring 44 acting as energy store. After the overcurrent expansion state has finished, the same pushes the expansion unit 16 counter to the expansion direction (arrow 20) back into its contracted initial position.

Here also, the illustration is to be understood as purely schematic; the energy store 44 shown can in principle act at any other points and, in the event of the dropping of the magnetic field 18, guide the expansion unit 16 back into the contracted position accordingly.

Figure 10:
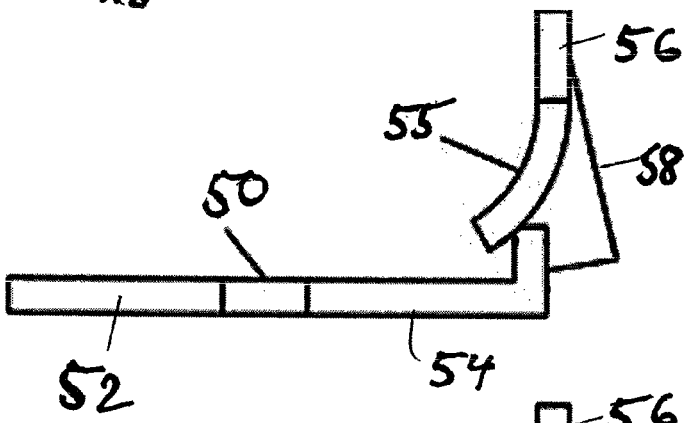
FIG. 10, FIG. 11 shows a further embodiment of the invention with an expansion unit looped directly into the electric circuit in the closed operating state (FIG. 10) and also in the expanded, open switching state as a reaction to overcurrent (FIG. 11).
Figure 11:
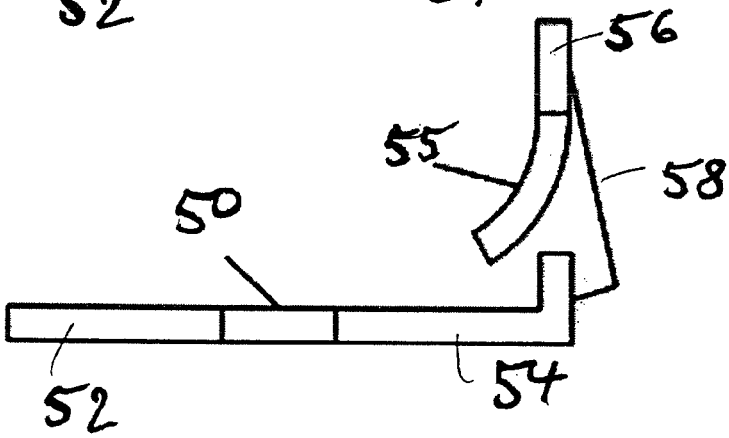

A further principle according to the present invention is explained using the example of FIGS. 10 and 11, in which principle an expansion unit 50, in turn realised from an MSM alloy material, is part of an electric circuit, as is symbolised by the adjacent conductor track sections 52 to 56 as normal conductors. In this case, a section 55 is provided between the conductor track sections 54 and 56 in such a manner that an expansion of the MSM alloy element 50 leads in the horizontal direction (right in the plane of the figure) to an opening of the electric circuit between the elements 55 and 56, wherein a schematically shown spring element 58 offers a restore force counteracting this expansion.

Here also, the principle according to the invention of a magnetic-field induced movement behaviour in the MSM element 50 is utilised, wherein the electric circuit arrangement is coil-free in the relevant region and the magnetic flux required for expansion here is generated directly by means of the current flow in the element 50. The magnetic induction at a radius r<=R within the conductor is $$B_{internal} = \frac{\mu_0 \mu_r I r}{2\pi R^2}$$

where R is the radius of the conductor 50 and I is the current flowing there.

This embodiment of the type clarified in FIGS. 11 *and* 12 is also to be understood as purely schematic and not limited to the realisation shown. Rather, numerous variants and modifications are possible, including the targeted influencing of the magnetic flux in the MSM section 50 due to the e.g. permanent magnet means or other measures to be provided separately.

The invention claimed is:

1. An overcurrent switching device for an electric circuit to be monitored, which has interrupter contact means (14) constructed in such a manner that an interruption of the electric circuit is effected as a reaction to the exceeding of a predetermined current threshold, wherein the interrupter contact means have an expansion unit (16) realised by means of a magnetically active shape memory alloy material, which is loaded by a magnetic field (18) of a current flowing in the electric circuit, wherein the expansion unit (16; 30; 32; 34) mechanically driving a contact, particularly an interrupter contact (14), is provided adjacently to a coil-free current-carrying conductor section (10) of the electric circuit for magnetic interaction in such a manner that above the predetermined current threshold, a current flow in the coil-free current-carrying conductor section (10) generates a magnetic field which effects an expansion movement of the expansion unit which interrupts the electric circuit, and wherein an entire length of said current-carrying conductor section (10), which is adjacent to said expansion unit (16; 30; 32; 34) is coil-free.

2. The device according to claim 1, wherein the conductor section is constructed in an elongated and/or linear manner.

3. The device according to claim 1, wherein the expansion unit (16) is constructed in an elongated manner in an expansion direction and is guided parallel to the conductor section (10) at least in certain sections.

4. The device according to claim 1, further comprising permanent magnet means (22) assigned to the expansion unit (16), which are constructed in such a manner that a permanent magnet field (24) of the permanent magnet means is laid over the magnetic field (18) generated by the conductor section with an effect on the expansion unit for influencing a magnetic-field-dependent expansion behaviour of the expansion unit, particularly an expansion of the expansion unit in the case of a lower current than the current threshold.

5. The device according to claim 1, further comprising means for predetermining and/or setting a magnetic coupling distance between the conductor section and the expansion unit.

6. The device according to claim 1, further comprising means for prestressing by means of a mechanical energy store, assigned to the expansion unit, which means are provided and constructed for influencing a magnetic-field-dependent expansion behaviour of the expansion unit.

7. The device according to claim 1, further comprising magnetic flux conduction means assigned to the expansion unit.

8. The device according to claim 7, wherein the flux conduction means are constructed and provided for influencing a magnetic-field-dependent expansion behaviour of the expansion unit.

9. The device according to claim 1, wherein the expansion unit (30; 32; 34) is constructed as a body surrounding and/or encompassing the conductor section at least in certain sections, preferably as a hollow cylinder.

10. The device according to claim 1, wherein the expansion unit (32, 34) comprises a configurable arrangement of a plurality of magnetic shape memory alloy bodies.

11. The device according to claim 1, wherein means (40; 44) for resetting, particularly for the contraction of the shape memory alloy material into a non-expanded initial form, are assigned to the expansion unit.

12. The device according to claim 11, wherein the means for resetting necessitate a manual intervention or control process.

13. The device according to claim 11, wherein the means for resetting are constructed for executing an automatic contraction of the shape memory alloy material as a reaction to a predetermined fall below the current threshold.

14. The device according to claim 13, wherein the means for resetting have permanent magnet means (40) and/or an energy store (44), particularly a spring.

15. The device according to claim 1, wherein the magnetic shape memory alloy material additionally has thermally effected expansion characteristics and is thermally coupled to the conductor section and/or another electric circuit section having a current-flow-dependent heating.

16. The device according to claim 15, further comprising means for setting and/or influencing a thermal coupling between the shape memory alloy material and the conductor section or electric circuit section.

17. An overcurrent switching device for an electric circuit to be monitored, which has interrupter contact means (54, 55) constructed in such a manner that an interruption of the electric circuit is effected as a reaction to the exceeding of a predetermined current threshold, wherein the interrupter contact means have an expansion unit realised by means of a magnetically active shape memory alloy material (50), wherein current flowing in the electric circuit flows in such a manner from a coil-free current-carrying conductor section (10) of the electric circuit through the expansion unit mechanically driving an interrupter contact as part of the electric circuit that above the predetermined current threshold, an expansion movement of the expansion unit which interrupts the electric circuit is effected, and wherein an entire length of said current-carrying conductor section (10) which is adjacent to said expansion unit is coil-free.

18. The overcurrent switching device according to claim 17, wherein the interrupter contact means have the expansion unit realised by means of a magnetically and thermally active shape memory alloy material (50).

* * * * *